United States Patent [19]

Thornton

[11] 3,991,895

[45] Nov. 16, 1976

[54] MOISTURE-PROOF CONTAINER SEAL

[76] Inventor: Theodore Wayne Thornton, 2036 Laird Drive, Salt Lake City, Utah 84108

[22] Filed: Feb. 20, 1976

[21] Appl. No.: 659,592

[52] U.S. Cl. ..... 215/211; 215/222; 215/320; 215/354

[51] Int. Cl.[2] ..... B65D 55/02; B65D 85/56; A61J 1/00

[58] Field of Search ..... 215/211, 222, 223, 320, 215/341, 354, DIG. 1

[56] References Cited

UNITED STATES PATENTS

| | | | |
|---|---|---|---|
| 3,592,349 | 7/1971 | Baugh | 215/354 X |
| 3,951,289 | 4/1976 | Landen | 215/211 |

*Primary Examiner*—George T. Hall
*Attorney, Agent, or Firm*—Mallinckrodt & Mallinckrodt

[57] ABSTRACT

A cover for a specially constructed receptacle having a circular entryway, such as a pharmaceutical vial of plastic, satisfies the present day requirement for moisture-proofing containers of moisture-affected medicines by providing an elongate, resilient plastic skirt which extends deeply into the entryway through the open mouth of the receptacle. Mutually confronting, coacting, circular formations internally of the receptacle and intermediate the length of the skirt interengage in sealing, line contact when the cover is secured over the open mouth of the receptacle. One of the circular formations has a sharp edge, the other is a smooth surface against which the sharp edge impinges. Either formation may be carried by either the receptacle or the skirt. For long useful life, the sharp edge is preferably of softer material than the smooth surface, so as not to indent nor otherwise damage the smooth surface. Securement of cover to receptacle may be of child-resistant or of easy-opening type.

16 Claims, 9 Drawing Figures

FIG. 1.
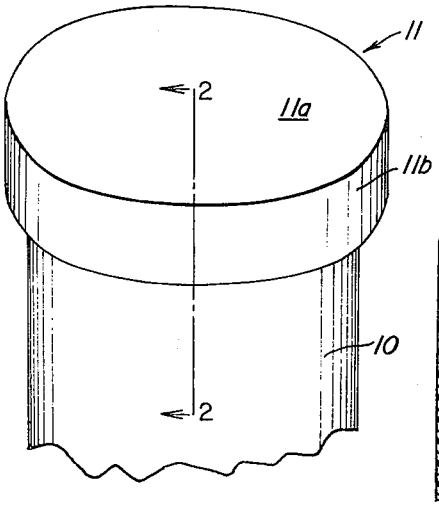
FIG. 4.
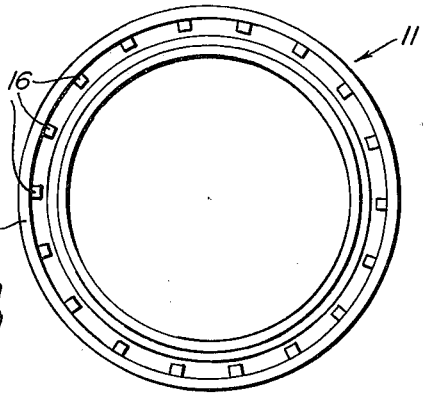
FIG. 8.
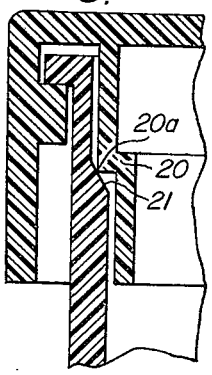
FIG. 5.
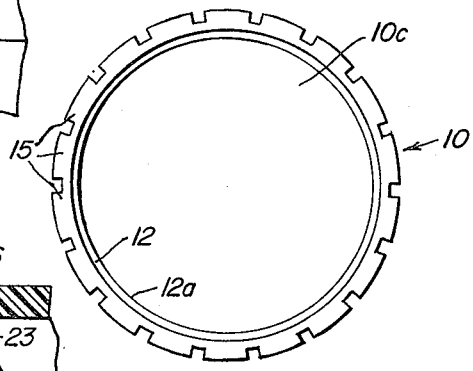
FIG. 2.
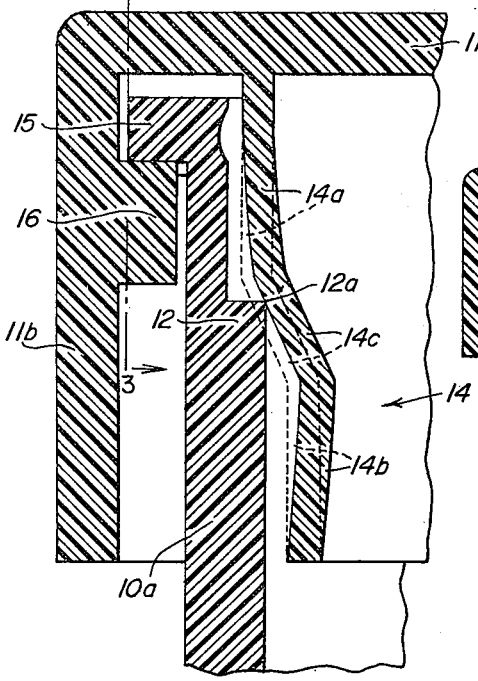
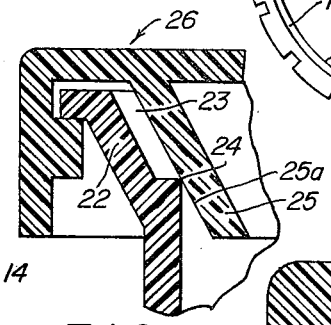
FIG. 9.
FIG. 7.
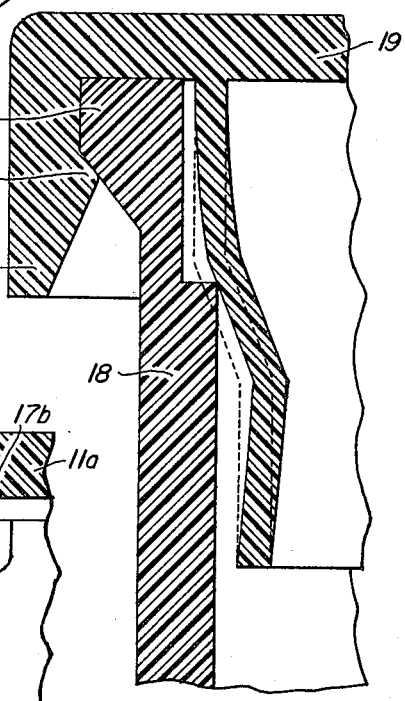
FIG. 3.
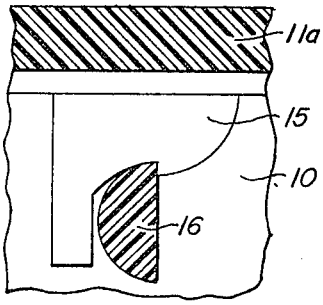
FIG. 6.
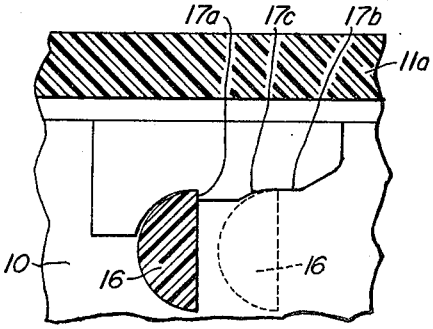

MOISTURE-PROOF CONTAINER SEAL

BACKGROUND OF THE INVENTION

1. Field

The invention is in the field of containers for pharmaceutical and other products that should be kept as free from contact with moisture as possible, and wherein the containers can be made resistant to opening by young children.

2. State of the Art

Many attempts have been made in the past to provide vials for the packaging of pharmaceuticals that would be resistant to opening by young children. Some have sought moisture-proofing as well. Although a variety of possible constructions have been proposed and gone into use, considerable room has been left for improvement in results. One approach of interest in connection with the present invention is that of U.S. Letters Pat. No. 3,880,313 granted to Edward G. Akers on Apr. 29, 1975, entitled "Safety Cap and Container." A difficulty all such containers have had in the utilization of plastic materials to provide resiliency is the rapidity with which such plastic materials take a set following repeated openings and closings of the container, or when the container is left closed for long periods of time. When the plastic material takes a set, the utility of the container for pharmaceutical purposes is destroyed.

SUMMARY OF THE INVENTION

In accordance with the invention, a receptacle having a circular entryway with an open mouth adapted to receive an elongate, plastic skirt that extends from the underside of a cover for such open mouth is provided internally of the entryway with a circular formation that coacts with a circular formation provided in an intermediate portion of the skirt to effect circular, sealing, line contact when the cover is in place on the receptacle, so as to exclude moisture from the receptacle. One of the coacting, circular formations has a sharp edge; the other is a smooth surface or face, against which the sharp edge impinges. Either formation may be carried by either the receptacle or the cover skirt.

In a preferred embodiment, one of the circular formations is an annular shoulder having a sharp corner protruding inwardly of the entryway as a circular seat for a smooth, intermediate surface portion of the plastic skirt of the cover. The cover comprises a cap portion for covering and closing the open mouth of the receptacle, the skirt extending downwardly from the underside of the cap portion for insertion within the entryway of the receptacle when the cover is put in place. In such preferred embodiment, a cylindrical lower skirt portion is offset inwardly from a cylindrical upper skirt portion, the two being interconnected by an intermediate skirt portion presenting a smooth face and adapted to engage the circular seat in resiliently urged, sealing, line contact with the sharp corner thereof.

Means are provided for holding the cap tightly in place over the mouth of the entryway. When such means are of child-resistant type, e.g. comprises sets of interlatching projections on cap and receptacle that require combined pressing and twisting forces to be exerted for opening purposes, the skirt advantageously acts as a spring to maintain the cap closed in the absence of the required opening forces that are beyond the ability of small children to exert. In any event, the skirt seals against the entry of moisture and is effective for this purpose over long periods of use because its elongate nature provides resistance to taking a set. A feature of the invention in an optional form thereof is a dual latching arrangement providing for easy opening with a first twist of the cover and child-resistant opening with a further twist of the cover, both positions affording moisture-proof closing of the receptacle.

THE DRAWING

In the drawing, which illustrates several versions of containers embodying the best modes presently contemplated of carrying out the invention in actual practice:

FIG. 1 is a fragmentary perspective view of the upper portion of a pharmaceutical vial with child-resistant cover latched in place;

FIG. 2, a fragmentary vertical section taken along the line 2—2 of FIG. 1 and drawn to a larger scale, the position of the depending skirt when the cover is free of the vial being indicated by dotted lines;

FIG. 3, a fragmentary vertical section taken along the line 3—3 of FIG. 2 and drawn to the same scale;

FIG. 4, a bottom plan view of the cover per se showing the latching projections;

FIG. 5, a top plan view of the vial per se showing the latching projections that interengage with the latching projections of FIG. 4;

FIG. 6, a view corresponding to that of FIG. 3, but illustrating a dual latching arrangement providing for child-resistance or not, selectively as desired;

FIG. 7, a view corresponding to that of FIG. 2, but illustrating an alternative arrangement, with snap-on cover rather than the child-resistant cover of the foregoing figures;

FIG. 8, a view corresponding to that of FIG. 2, but drawn to a considerably smaller scale and illustrating a reversal of the moisture-sealing components; and FIG. 9, a view corresponding to that of FIG. 8, but illustrating another version of the container.

DETAILED DESCRIPTION OF ILLUSTRATED EMBODIMENTS

In the form of the invention illustrated in FIGS. 1–5, a pharmaceutical vial 10, constituting a receptacle for moisture-affected medicines, is molded in cylindrical formation from a plastic material, such as polyethylene, that is inherently moisture-proof. A cover 11 is molded from a harder plastic material, such as polypropylene, that is also inherently moisture-proof.

Vial 10 has an entryway portion **10*a* that is circular and defines an entryway 10*b* having an open mouth 10*c*. An annular shoulder 12 protrudes inwardly of the entryway to provide a sharp corner as a circular seat 12*a* for a plastic skirt that depends from cover 11**.

Cover 11 is desirably molded integrally from the plastic material to provide a cap portion **11*a*, a rim skirt 11*b* depending from the cap portion for overhanging vial 10 externally thereof when the cover is in place, and an elongate skirt 14 depending from the underside the cap portion for insertion in entryway 10*b*** of the vial when the cover is in place.

Elongate skirt 14 is inherently resilient and has an upper skirt portion **14*a*, an inwardly offset lower skirt portion 14*b*, and an inwardly and downwardly sloping smooth faced, intermediate skirt portion 14*c* interconnecting the upper and lower skirt portions and adapted, when the cover is in place, to rest firmly upon circular seat 12***a* of vial 10 in sealing, line contact therewith, as indicated in FIG. 2. The plastic material of the skirt is desirably thin, e.g. 0.040 of an inch as compared to normal wall thickness of vial and cover of 0.050 of an inch.

When cover 11 is applied to vial 10, skirt 14 flexes inwardly, as shown, from the normal position indicated by dotted lines in FIG. 2, and is maintained by the inherent resiliency of the plastic material in the aforementioned sealing, line contact with the sharp corner 12*a* of shoulder 12. The tendency for the plastic material of skirt 14 to acquire a "set" is minimized almost completely from a practical standpoint by the elongate nature of the skirt, with seating contact established intermediate its length.

Although skirt formation will conform to receptacle entryway formation in any given instance, it is preferred that the entryway and the upper and lower skirt portions be cylindrical, as is the case in the illustrated embodiment.

The means for tightly retaining the cover on the receptacle, is preferably of not easily disengaged, child-resistant type. As illustrated in the embodiment of FIGS. 1–5, vial 10 has a set of latching projections 15 rimming mouth 10*c* externally of the vial, while cover 11 has a mating set of latching projections 16 extending internally of its rim skirt 11*b*. Projections 16 are preferably of keeper lug formation, as shown in FIG. 3, while projections 15 are preferably of receiving hook formation. Moreover, there are preferably a multiplicity of closely spaced projections 15 and 16 in the respective sets, for the purpose of minimizing the effects of wear and of distributing biting pressures, that are often applied by small children in their efforts to open a closed container, so such efforts are ineffective. It will be noted from the drawings that the annular sealing formation 12*a* of the vial 10 is preferably spaced remotely from the latching projections 15 of such vial.

As is apparent, combined pressing and turning forces applied by an adult, desirably by the palm of one hand while the vial is being held by the other hand, will be effective to open a closed vial, while closing of the vial requires merely the application of the cover to the vial and turning the cover while the vial is held stationary.

Since a pharmacist is often called upon to provide medicine for households in which there are no small children or in instances in which ease of opening the container is particularly desired, as with elderly people, it is advantageous to provide for either in the same container. Thus, as shown in FIG. 6, the latching projections of hook formation, identified as 15 in FIG. 3, are made as shown in 17 in FIG. 6. Besides the positively locking hook 17*a* for child-resistance purposes, each of the projections 17 are provided with a slight nub 17*b* at its forward end leading into a retention bed 17*c* in advance of hook 17*a*. For ease of opening, keeper lugs 16 of the cover are advanced during the closing twist only into respective retention beds 17*c* (see the dotted line position of FIG. 6), where they are retained by friction. Resistance to further twisting indicates proper placement in beds 17*c*. For child-resistance, the closing twist (best accomplished by combined pressure and twisting with the palm of the hand) is continued past the resistance met following traverse by the keeper lugs of the beds 17*c* to the locking position shown in full lines. It should be noted that effective moisture-sealing is carried out by the sealing skirt in both of these two possible positions of the cover and that the resilient action of the skirt also effectively maintains frictional latching of the cover in the initial, easy-to-open position of the cover.

Although it is preferred to make the container of the invention of the foregoing child-resistant or dual type, since required tolerances are easier to achieve in manufacture, it is possible to provide the container with a usual type of easily disengaged cover by providing the means for retaining the cover on the container of relatively non-resistant type.

Thus, as shown in FIG. 7, a vial 18 may be provided with the usual type of snap-on, cover-receiving rim 18*a*, and the cover 19 therefor may be of usual snap-on type provided with the usual inwardly-protruding, latching ring portion 19*a* interiorly of its rim skirt 19*b*. Otherwise, the elements of both vial and cover are the same as for the previous embodiment, all as is illustrated in FIG. 7.

As illustrated in FIG. 8, the placements of the annular shoulder, with its sharp corner, and of the smooth-faced, intermediate portion of the skirt can be reversed, with the shoulder and its sharp edged seat being formed intermediate the length of the skirt, as at 20 and 20*a*, respectively, and with the smooth, annular, seating face therefor being formed internally of the receptacle, as at 21.

The embodiment of FIG. 9 indicates how the container of the invention can be made with circular but non-cylindrical entryway for the receptacle and a skirt without a distinctly defined intermediate portion. Thus, entryway portion 22 of the receptacle converges downwardly from the open mouth 23 and has a sharp edge 24 against which the smooth-faced intermediate portion 25*a* of inverted, frusto-conical skirt 25 impinges when cover 26 is in place on the receptacle.

In all embodiments of the invention, as previously mentioned, it is desirable, to insure a long and fully useful life for the container, that the sharp corner or edge of the mutually coacting, circular formations be of a softer material than the smooth circular surface against which the sharp corner or edge impinges.

Whereas this invention is here illustrated with respect to embodiments representing the best modes presently contemplated for carrying it out in practice, it should be understood that various changes may be made without departing from the inventive concepts particularly pointed out in the claims which follow.

I claim:

1. A moisture-proof container, comprising a receptacle having a circular entryway with an open mouth adapted to receive a cover; a cover for the open mouth; an elongate, inherently resilient, plastic skirt extending from the underside of the cover for insertion within said entryway when the cover is applied to the receptacle; mutually confronting and coacting annular formations that are resiliently pressed together intermediate the length of the skirt, internally of the container when closed, one of said formations having a sharp edge as a circular seat, the other having a smooth, circular, seating face for coaction with said sharp edge in establishing circular, sealing, line contact between the two; and means for tightly retaining the cover on the receptacle.

2. A container in accordance with claim 1, wherein the one formation having the sharp edge is part of the receptacle, and the other formation having the smooth seating face is part of the skirt.

3. A container in accordance with claim 2, wherein the skirt has an upper skirt portion, a lower skirt portion offset inwardly from the upper skirt portion, and an inwardly and downwardly sloping intermediate skirt portion interconnecting said upper and lower skirt portions and providing the annular seating face for engaging the circular seat in sealing, line contact with the sharp edge thereof, the annular formation that provides said seat being part of the receptacle.

4. A container in accordance with claim 1, wherein the lower portion of the skirt is about the same length as the upper portion of the skirt.

5. A container in accordance with claim 4, wherein the entryway portion of the receptacle and both the upper and lower skirt portions of the cover are of substantially cylindrical formation.

6. A container in accordance with claim 1, wherein the means for retaining the cover on the receptacle comprise interengaging members on receptacle and cover, respectively, of not easily disengaged, child-resistant type; and wherein resilient seating of the skirt on the seat effects resistance to disengagement.

7. A container in accordance with claim 6, wherein the means for retaining the cover on the receptacle comprise a skirt rimming the cap portion of the cover for overhanging the receptacle externally thereof; a set of latching projections rimming the mouth of the receptacle externally thereof; and a second set of latching projections extending from said rimming skirt internally thereof, the two sets of projections being adapted to interengage upon application of the cover to the receptacle and to be disengaged upon application of simultaneous pressing and turning force to cover and receptacle.

8. A container in accordance with claim 7, wherein there are a multiplicity of closely spaced, latching projections in each set.

9. A container in accordance with claim 8, wherein the latching projections rimming the mouth of the receptacle are of hook formation and the latching projections extending from the rimming skirt of the cover are of keeper lug formation adapted to be received and locked by said hook formations; and wherein each of the latching projections of hook formation have an easily disengaged retention bed in advance of the hook formation thereof, which can be selectively engaged by a keeper lug during closing of the receptacle.

10. A container in accordance with claim 1, wherein the means for retaining the cover on the receptacle comprise interengaging members of easily disengaged, relatively non-resistant type.

11. A container in accordance with claim 1, wherein the receptacle is a pharmaceutical vial of cylindrical formation made of polyethylene plastic or the like, and the cover, including the skirt, is of a harder plastic material.

12. A container in accordance with claim 11, wherein the means for retaining the cover on the vial comprise a skirt rimming the cap portion of the cover for overhanging the vial externally thereof; a multiplicity of closely spaced latching projections rimming the mouth of the vial externally thereof; and a multiplicity of closely spaced latching projections extending from said rimming skirt internally of the cover, the two sets of projections being adapted to interengage upon application of the cover to the vial and to be disengaged upon application of simultaneous pressing and turning force to the cover and the vial, the elongate skirt serving as a spring urging the cover away from the vial.

13. A container in accordance with claim 12, wherein each of the latching projections rimming the mouth of the vial has a hook formation and each of the latching projections internally of the cover is of keeper lug formation adapted to engage with the hook formation of a latching projection of the vial to provide child-resistance in the opening of the container; and wherein each of the latching projections of the vial has a latching bed in advance of the hook formation for selective engagement by a latching projection of the cover to provide easy disengagement of the cover from the vial.

14. A container including a receptacle having an open mouth and a cover for said open mouth wherein the cover may be selectively applied to the receptacle in either a child-resistant manner or an easy-to-remove manner, said container comprising sets of locking projections rimming the cover and said open mouth of the receptacle, respectively, the projections of one of said sets being of hook formation and the projections of the other of said sets being of keeper lug formation for engaging and latching with said projections of hook formation, and the said projections of hook formation each having an easily disengaged bed in advance of the hook formation thereof, which can be selectively engaged by a keeper lug during closing of the receptacle.

15. A container in accordance with claim 7, wherein the receptacle is molded from a plastic material and the sealing formation of said receptacle is spaced remotely from the latching projections thereof.

16. A container in accordance with claim 12, wherein the sealing formation of the vial is spaced remotely from the latching projection thereof.

* * * * *